US010065332B2

(12) United States Patent
Leyens et al.

(10) Patent No.: US 10,065,332 B2
(45) Date of Patent: Sep. 4, 2018

(54) DEVICE FOR SPLITTING FOAM BODIES

(75) Inventors: Norbert Leyens, Walhorn (BE); Stefan Lennartz, Gangelt (DE)

(73) Assignee: Fecken-Kirfel GmbH & Co. KG, Aachen (DE)

( * ) Notice: Subject to any disclaimer, the term of this patent is extended or adjusted under 35 U.S.C. 154(b) by 163 days.

(21) Appl. No.: 13/515,831

(22) PCT Filed: Dec. 20, 2010

(86) PCT No.: PCT/EP2010/070264

§ 371 (c)(1),
(2), (4) Date: Jun. 14, 2012

(87) PCT Pub. No.: WO2011/083037

PCT Pub. Date: Jul. 14, 2011

(65) Prior Publication Data

US 2012/0247290 A1 Oct. 4, 2012

(30) Foreign Application Priority Data

Jan. 8, 2010 (DE) ..... 10 2010 004 205

(51) Int. Cl.

| | |
|---|---|
| ***B26D 7/32*** | (2006.01) |
| ***B26D 3/28*** | (2006.01) |
| ***B26D 1/46*** | (2006.01) |
| ***B26D 7/18*** | (2006.01) |

(52) U.S. Cl.

CPC ..... *B26D 3/28* (2013.01); *B26D 7/1845* (2013.01); *B26D 3/281* (2013.01); *Y10T 83/0448* (2015.04); *Y10T 83/2092* (2015.04); *Y10T 83/2192* (2015.04)

(58) Field of Classification Search

CPC ..... B26D 3/28; B26D 3/281; B26D 7/1845; B26D 3/008

USPC ..... 83/23, 4, 811, 820, 661, 812, 835–855, 83/109, 155, 813, 788, 794, 801, 703, 83/875, 826, 827, 862, 865, 404, 871, 83/809; 409/165; 29/564, 335

See application file for complete search history.

(56) References Cited

U.S. PATENT DOCUMENTS

| | | | | | |
|---|---|---|---|---|---|
| 1,551,900 | A | * | 9/1925 | Morrow | 83/477.2 |
| 3,957,555 | A | * | 5/1976 | Bondi | 156/72 |
| 4,244,465 | A | | 1/1981 | Hishikawa et al. | |
| 4,621,669 | A | * | 11/1986 | Kivimaa | 144/365 |
| 5,060,014 | A | * | 10/1991 | Adachi et al. | 399/174 |

(Continued)

FOREIGN PATENT DOCUMENTS

| | | | | | |
|---|---|---|---|---|---|
| DE | 1729544 | U | * | 9/1956 | B26D 7/32 |
| DE | 10-2004-046517 | A1 | | 3/2006 | |

(Continued)

OTHER PUBLICATIONS

International Search Report and Written Opinion dated Apr. 15, 2011 from corresponding International Patent Application No. PCT/EP2010/070264—dated Apr. 8, 2011 pages.

*Primary Examiner* — Ghassem Alie
(74) *Attorney, Agent, or Firm* — Maier & Maier, PLLC

(57) ABSTRACT

A thin layer is cut from a foam material body using a band-knife. A take-off device that lifts and removes the layer from the cutting site, includes a belt conveyor with an electrostatically chargeable conveyor element. The layer is lifted and removed from the cutting site by electrostatic attraction to the conveyor element.

10 Claims, 2 Drawing Sheets

(56) References Cited

U.S. PATENT DOCUMENTS

Figure 1:
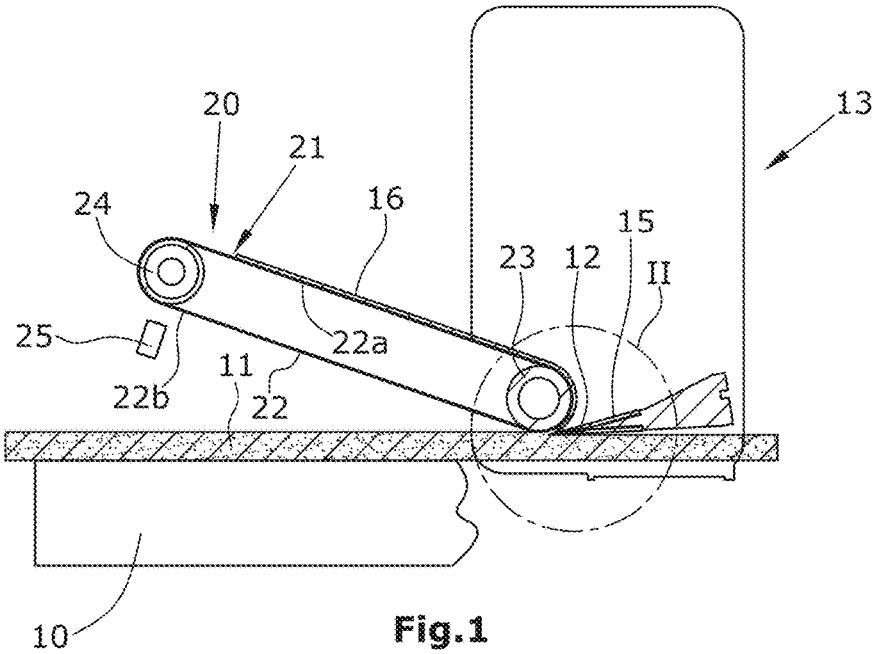

| | | | | | |
|---|---|---|---|---|---|
| RE34,827 | E | * | 1/1995 | Dover et al. | 172/19 |
| 5,400,208 | A | * | 3/1995 | Pazda et al. | 361/221 |
| 6,145,561 | A | * | 11/2000 | Watanabe et al. | 156/517 |
| 6,209,430 | B1 | * | 4/2001 | Desmarais et al. | 82/47 |
| 6,223,830 | B1 | * | 5/2001 | deVries | 172/19 |
| 6,269,724 | B1 | * | 8/2001 | Sabatelli et al. | 83/813 |
| 6,516,940 | B1 | * | 2/2003 | Hart et al. | 198/781.1 |
| 6,820,671 | B2 | * | 11/2004 | Calvert | 156/543 |
| 7,335,090 | B2 | * | 2/2008 | Takahashi | 451/41 |
| 2006/0061030 | A1 | * | 3/2006 | Kaneko et al. | 270/52.17 |
| 2009/0152173 | A1 | * | 6/2009 | Miller et al. | 209/129 |
| 2010/0282647 | A1 | * | 11/2010 | Miller et al. | 209/12.2 |
| 2012/0207577 | A1 | * | 8/2012 | Stollery et al. | 414/792.9 |

FOREIGN PATENT DOCUMENTS

| | | | |
|---|---|---|---|
| DE | 10-2007-040610 | B3 | 7/2009 |
| EP | 177183 | A1 | 4/2007 |
| GB | 789343 | A | 1/1958 |
| WO | 99-16593 | A1 | 4/1999 |

* cited by examiner

DEVICE FOR SPLITTING FOAM BODIES

RELATED APPLICATIONS

This is the U.S. national stage application which claims priority under 35 U.S.C. § 371 to International Patent Application No.: PCT/EP2010/070264, filed Dec. 20, 2010, which claims priority to German Patent Application No. 10 2010 004 205.6, filed Jan. 8, 2010, the disclosures of which are incorporated by reference herein their entireties.

The invention refers to a device for splitting foam material bodies, comprising an endless band-knife having a cutting edge for separating a layer from the foam material body, and further comprising a take-off device for removing the layer from the foam material body.

When splitting foam material bodies, such as webs or blocks, the body, lying on a sliding table or a transport belt, is pushed through a cutting aggregate in which a band-knife circulates that separates the respective top layer from the body. Here, it often is the task of an operator of the machine to remove the layers immediately after the splitting operation. Especially when cutting very thin layers in a range less than 5 mm, some materials have no more inherent rigidity in the layers separated so that the layers are no longer advanced and pushed out of the cutting region by the following material after they have been cut from the block. Thus, they remain lying flabbily in the cutting region, e.g., on the knife guide. Machines are known in which the layers are transported away after cutting by sliding over the knife guide and by being transported away on a transport belt or being placed on a table, said belt or table being provided downstream of the knife guide. However, such a possibility is only suitable for layers of sufficient thickness or inherent rigidity to be pushed forward by the following material. In cutting layers or in paper processing, machines are known that use suction rolls, whereby layers are sucked to rolls for transport. For this purpose, there are embodiments of a suction conveyor roll with an outer rotatable sleeve having suction holes distributed over the circumference. Here, the layers are sucked to the roll by means of a vacuum introduced into the hollow roll provided with suction bores, whereby they are transported or removed from the processing area.

DE 10 2007 040 610 describes a device in which an inner pipe is surrounded by an outer perforated pipe. The inner pipe comprises a suction bore via which bores in the wall of the outer pipe are connected to a suction device in groups so that a suction effect is created only in a part of the circumference. All suction methods require that the material to be processed is impermeable to air.

Machines are known, in which electrically non-conductive materials or materials of low electric conductivity are fixed for processing by means of the electrostatic effect (DE 19 902 821). In particular in the field of non-woven fabric processing, layers are fixed (CN 1951788) or transported (EP 1777182, EP 1702874) by means of the electrostatic effect. Moreover, applications exist where, for instance, sand grains are drawn to a surface by means of electrostatic effects so that sand paper used for grinding purposes can be manufactured.

It is an object of the invention to provide a device for splitting foam material bodies which allows for an interference-free removal of a separated material layer from a foam material body and is further suitable for splitting off thin instable layers.

The device of the present invention is defined in claim 1. It is characterized in that the take-off device for removing the layer from the foam material body comprises an electrostatically chargeable conveyor element that removes the split-off layer from the foam material body at the cutting site where the cutting edge engages.

According to the invention, the split-off layer is taken from the foam material body using electrostatic forces. In this manner, even thin layers of less than 5 mm in thickness can be transported away in a controlled and safe manner. The surface of the conveyor element may be charged with positive or negative electrostatics using an electric ionization means. Since the foam material is grounded through the sliding table and through the contact with the knife or the knife guide, it is electrostatically neutral. Thus a positive or negative electrostatic charge of the conveyor element will attract the material. Immediately after cutting, the differential charge and the electric field formed thereby between the material and the take-off band draw the split-off material towards the take-off band where the material is held. The main advantage over the conventional methods and arrangements is that the uniform charging of the band guarantees for a very uniform and homogeneous removal of the material from the knife guide. Thereby, the split-off layer is separated from the rest of the material without varying pulling conditions and a very uniform cutting is achieved without negative effects of the removal on the layer.

In the context of the present invention, the term "foam material" should be interpreted in a broad sense. It encompasses all kinds of cellular material, among others also polyurethane foam, cellular rubber and neoprene, as well as compact plastic materials without cells, rubber or PU elastomeres.

Preferably, the conveyor element is a flexible endless band circulating about a guide roll, wherein a first guide roll is provided at the site at which the cutting edge of the band-knife engages the foam material body. This allows for a rather long discharge path for the split-off layer. Moreover, there is an advantage in that the conveyor element can be guided along a charging device which may be positioned at an appropriate place.

The take-off device may be a belt conveyor which either has an upper strand or a lower strand provided for transporting away the split-off layer. An operator or an automatic take-off means may remove the split-off thin layer from the belt conveyor. In both embodiments it is practical that the electrostatically charged conveyor element is synchronized with the speed of a sliding table carrying the foam material body during processing, such that an adjustable difference in speed is not more than 20 percent.

The device of the present invention also allows for the simultaneous processing of a plurality of foam material bodies side by side and/or one after the other in the same machine so as to produce a plurality of layers in one splitting operation. Such a mode of operation is not possible with the conventional devices, since these require an operator for each simultaneously cut layer to remove a respective layer from a roll.

The electrically charged conveyor element made from an electrically non-conductive material may be passed along an electrostatic charging device, e.g., an ionization means, so that a homogeneous electrostatic charging is made as the belt circulates.

The invention further refers to a method of splitting a foam material body, wherein the split-off layer is removed from the foam material body by means of electrostatic attraction to a conveyor element.

The following is a detailed description of embodiments with reference to the accompanying drawing.

Figure 2:
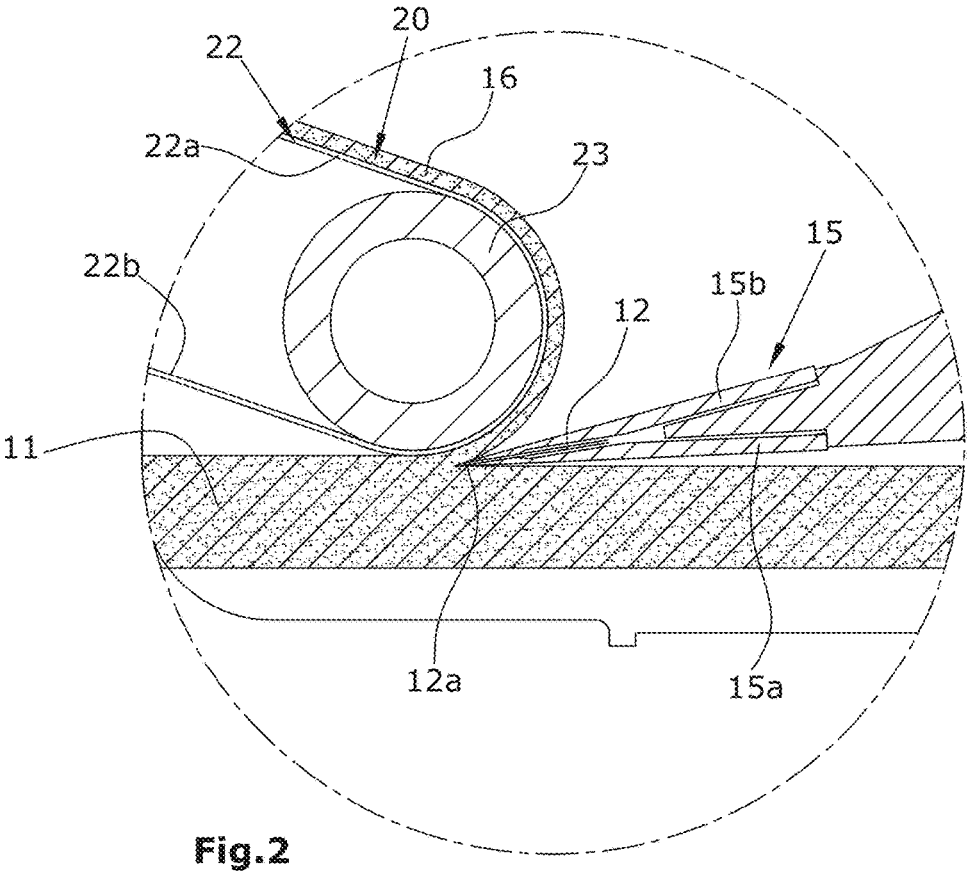
Figure 3:
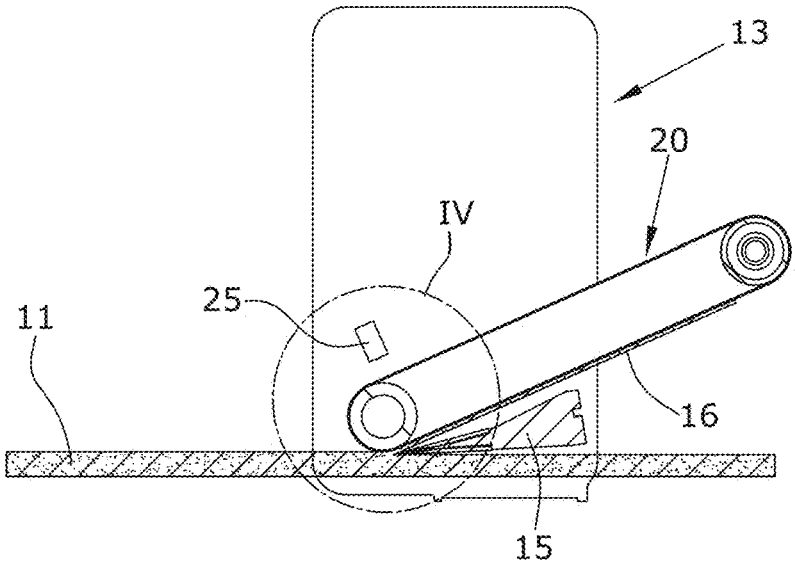
Figure 4:
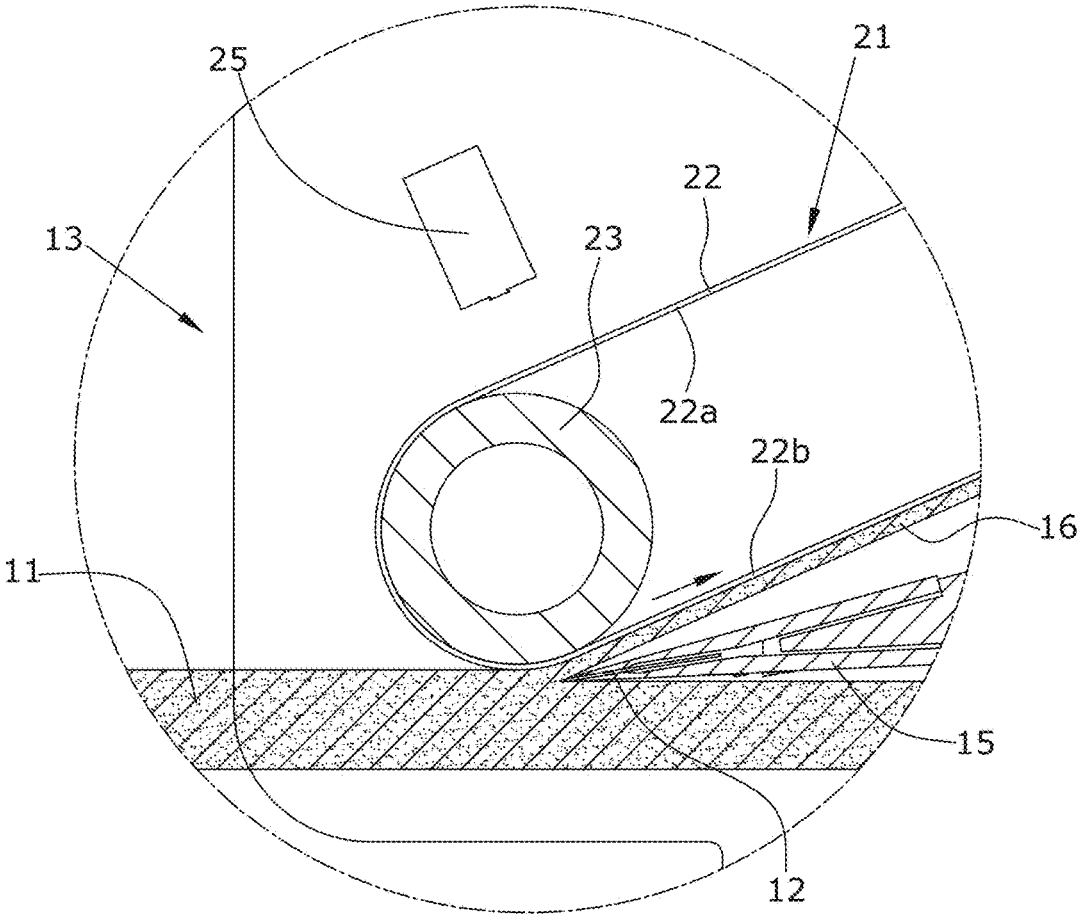

In the Figures:

FIG. 1 is a schematic side elevational view of a first embodiment of a device for splitting foam material bodies, FIG. 2 is an enlarged illustration of the detail II in FIG. 1, FIG. 3 is a side elevational view of a second embodiment of the device, and FIG. 4 is an enlarged illustration of the detail IV in FIG. 3, FIGS. 1 and 2 illustrate a device comprising a sliding table 10 which can be displaced horizontally in order to move a foam material body 11 horizontally against a knife 12. The knife 12 is part of a splitting device 13. It is also possible to provide a stationary table 10 and to move the splitting device 13. The sliding table 10 includes means for retaining the foam material body 11 thereon, for example a suction device.

The knife 12 is an endless band-knife circulating around knife discs (not illustrated) on a closed trajectory. The band-knife 12 has a front cutting edge 12*a*. It is arranged under an acute angle with respect to the surface of the foam material body 11 and is guided in a knife guide 15 formed by two guide plates 15*a*, 15*b*. The knife guide 15 leaves the cutting edge 12*a* of the knife 12 exposed so that the same can penetrate into the foam material body 11 in order to split off a layer 16 from the foam material body.

The layer 16 is removed by the take-off device 20. The take-off device comprises a belt conveyor 21 with an endless conveyor element 22 circulating around guide rolls 23, 24. The belt conveyor 21 is oriented obliquely, with the lower guide roll 23 being positioned almost tangentially to the surface of the foam material body 11 before the layer 16 is split. The other guide roll 24 is placed higher so that the belt conveyor 21 carries the layer 16 away in a forward and upward direction, the transport being effected on the upper strand 22*a*. At a site along the belt conveyor 21, at which the layer 16 has already been taken from the conveyor element 22, an electrostatic charging device 25 is provided along which the conveyor element 22 moves. In the present instance, the charging device 25 is an ionization means for electrically charging the conveyor element made of non-conductive material. In this embodiment, the charging device 25 acts on the lower strand 22*b* of the conveyor element.

The centre of the guide roll 23 is arranged at a distance from the surface of the foam material body that corresponds to the radius of the guide roll plus the thickness of the layer 16. The cutting edge 12*a* is located at that site of the layer 16 that is just lifted from the foam material body 11 by the guide roll 23. The cutting edge 12*a* thus enters the gap in the foam material formed by the guide roll 23. This means, the layer 16 is lifted from the foam material body 11 immediately at the cutting site and is removed by means of the take-off device 20. This allows for a controlled and interference-free continuous lifting and removal of the layer 16.

In the embodiment illustrated in FIGS. 1 and 2, the layer 16 runs around the guide roll 23 in an angular range that is larger than 90 degrees, before it reaches the upper strand 22*a*. The layer 16 thus virtually folded back.

The embodiment illustrated in FIGS. 3 and 4 is largely similar to the first embodiment with the difference that the material transport of the layer 16 is directed "rearward", i.e. towards the knife guide 15. Again, the guide roll 23 is arranged tangentially to the surface of the non-split foam material body 11; however, the belt conveyor 21 in this embodiment is arranged such that it covers the knife guide 15. The layer 16 comes to lie on the bottom face of the lower strand 22*b* of the belt conveyor 21 and is transported away "overhead" as it were. The charging device 25 arranged opposite the upper strand 22*a*. In any event, the charging device is positioned such that it can charge the conveyor element 22 before it enters the cutting region so as to guarantee a homogeneous charging.

The invention combines the cutting operation and the removal operation. It is important that not only the transport of the layer 16, but also the taking-off and the lifting are effected by electrostatic attraction immediately after the cutting operation. Thereby, the split-off material is transported uniformly and with a constant pull out from the cutting region.

The invention claimed is:

1. A method for splitting a foam material body with a circulating band-knife, comprising: moving the foam material body with respect to the band-knife so as to split off a layer, and wherein the split-off layer is continuously removed away from the band knife at an angular range larger than 90 degrees immediately after having been split off from the foam material body, wherein a direction of separation is in a forward direction less than 90 degrees from an uncut portion of the foam material body and greater than 90 degrees from a cut portion of the foam material body, wherein the layer is subsequently lifted and removed from the material body by electrostatic attraction to a conveyor element oriented obliquely to a surface of the foam material body, wherein a portion of the conveyor element is positioned almost tangentially to the surface of the foam material body, wherein the foam material is grounded through contact with the knife or a knife guide guiding the knife and electrostatically neutral; and wherein the conveyor element has a lower distal end positioned substantially above a cutting tip of the circulating band knife, the lower distal end of the conveyor element positioned so that at least a portion of the lower distal end is disposed past the cutting tip of the circulating band knife in a tip direction.

2. The method of claim 1, wherein the lifting and removal of the layer is affected by the conveyor element in a continuous manner and with a constant pulling force.

3. A device for splitting foam material bodies, comprising an endless band-knife which has a cutting edge for splitting off a layer from the foam material body, and further comprising a take-off device for removing the layer from the foam material body, wherein the take-off device comprises an electrostatically chargeable conveyor element oriented obliquely to a surface of the foam material body that removes the split-off layer from the foam material body in an upward direction at the cutting position where the cutting edge engages, wherein the layer is subsequently lifted and removed from the material body in a forward direction away from the endless band knife at an angular range larger than 90 degrees, said forward direction being less than 90 degrees from an uncut portion of the foam material body and greater than 90 degrees from a cut portion of the foam material body, wherein a portion of the chargeable conveyor element is positioned almost tangentially to the surface of the foam material body, and wherein the foam material is grounded through contact with the knife or a knife guide guiding the knife and electrostatically neutral; and wherein the electrostatically chargeable conveyor element has a lower distal end positioned substantially above a cutting tip of the endless band knife, the lower distal end of the electrostatically chargeable conveyor element positioned so that at least a portion of the lower distal end is disposed past the cutting tip of the endless band knife in a tip direction.

4. The device of claim 3, wherein the conveyor element is a flexible endless band circulating around guide rolls, a first guide roll being arranged at the cutting position where the cutting edge of the band-knife engages the foam material body.

5. The device of claim 3, wherein the take-off device is a belt conveyor with an upper strand for transporting away the split-off layer.

6. The device of claim 3, wherein the take-off device is a belt conveyor with a lower strand for transporting away the split-off layer.

7. The device of one of claim 3, wherein the conveyor element is a band made from an electrically non-conductive material, and that an electrostatic charging device is arranged stationary along the path of the band.

8. The device of claim 7, wherein the charging device comprises an electric ionization device.

9. The device of one of claim 3, wherein the movement of the conveyor element is synchronized with the speed of the foam material body, such that an adjustable difference in speed is not greater than 20 percent.

10. A device for splitting foam material bodies, comprising an endless band-knife which has a cutting edge for splitting off a layer from the foam material body, and further comprising a take-off device for removing the layer from the foam material body, wherein the take-off device comprises an electrostatically chargeable conveyor element oriented obliquely to a surface of the foam material body that removes the split-off layer from the foam material body in an upward direction at the cutting position where the cutting edge engages, wherein the layer is subsequently lifted and removed from the material body in a forward direction away from the endless band knife at an angular range smaller than 90 degrees, wherein a portion of the chargeable conveyor element is positioned almost tangentially to the surface of the foam material body, wherein the chargeable conveyor element is a belt conveyor comprising a lower strand, the lower strand transports away the layer, and wherein the foam material is grounded through contact with the knife or a knife guide guiding the knife and electrostatically neutral; and wherein the electrostatically chargeable conveyor element has a lower distal end positioned substantially above a cutting tip of the endless band knife, the lower distal end of the electrostatically chargeable conveyor element positioned so that at least a portion of the lower distal end is disposed past the cutting tip of the endless band knife in a tip direction.

* * * * *